United States Patent [19]

Guerrini et al.

[11] 3,960,259

[45] June 1, 1976

[54] RIBBON CARTRIDGE FOR TYPEWRITER, CALCULATING, ACCOUNTING OR LIKE OFFICE MACHINES

[75] Inventors: Gian Paolo Guerrini, Ivrea (Turin); Giuseppe Oddicini, Banchette (Turin), both of Italy

[73] Assignee: Ing. C. Olivetti & C., S.p.A., Ivrea (Turin), Italy

[22] Filed: Aug. 23, 1974

[21] Appl. No.: 499,964

Related U.S. Application Data

[63] Continuation-in-part of Ser. No. 292,597, Sept. 27, 1972, Pat. No. 3,877,561.

[30] Foreign Application Priority Data

Oct. 4, 1971 Italy ..... 70243/71

[52] U.S. Cl. ..... 197/151

[51] Int. Cl.[2] ..... B41J 33/14

[58] Field of Search ..... 197/151, 175

[56] References Cited

UNITED STATES PATENTS

| | | | |
|---|---|---|---|
| 3,151,724 | 10/1964 | Ross | 197/151 |
| 3,260,344 | 7/1966 | Doyle | 197/151 |
| 3,272,304 | 9/1966 | Morelli | 197/151 |
| 3,356,202 | 12/1967 | Goff | 197/151 |
| 3,396,828 | 8/1968 | Moshier | 197/151 |
| 3,877,561 | 4/1975 | Guerrini et al. | 197/151 |

*Primary Examiner*—Harland S. Skogouist
*Attorney, Agent, or Firm*—I. J. Schaefer

[57] ABSTRACT

A cartridge for an ink or carbon ribbon of an office machine comprises a container of parallelepipedal form in which a pair of spools are rotatable for the ink or carbon ribbon. A part of the ink or carbon ribbon extends through one aperture to the exterior of the container and returns to the interior through another aperture. Two arms are associated with the two apertures and project from the exterior of the container. The arms support the portion of the ink or carbon ribbon exterior of the container, away from the container, when the container is removed from the machine and makes the insertion of the ink or carbon ribbon arms in a lift ribbon guide upon mounting of the container on the same machine. The container is further provided with a window disposed over the periphery of one of the two spools for manually rewinding the ink or carbon ribbon on the spool after the container is mounted on the machine.

3 Claims, 4 Drawing Figures

RIBBON CARTRIDGE FOR TYPEWRITER, CALCULATING, ACCOUNTING OR LIKE OFFICE MACHINES

CROSS REFERENCE TO RELATED APPLICATION

This application is a continuation-in-part of the application No. 292,597 filed on Sept. 27, 1972, now U.S. Pat. No. 3,877,561 for "Cartridge for the carbon ribbon of a typewriter, calculating machine, accounting machine or like office machines".

BACKGROUND OF THE INVENTION

The present invention relates to a cartridge for an ink or carbon ribbon for a typewriter, calculating machine, accounting machine or other office machines, wherein the cartridge comprises a container of parallelepipedal form in which are rotatable a pair of spools adapted to wind the ink or carbon ribbon. The ink or carbon ribbon extends outside the container and reenters through a pair of apertures in the container which are adjacent the pair of spools.

A carbon ribbon cartridge of the aforesaid type is known in which the carbon ribbon is unwound from a feed spool and is passed through an aperture to the exterior of the cartridge. The carbon ribbon is mounted manually on two lift ribbon guides and through a second aperture of the cartridge and is guided over a corresponding take-up spool. A knob, integral with the take-up spool, extends through an upper wall of the cartridge to permit grasping thereof for manually turning of the take-up spool. The disadvantage of this cartridge is that the carbon ribbon is not guided in the exterior of the cartridge and the carbon ribbon must be always handled by the operator's hands for mounting same on the lift ribbon guides causing the operator's hands to get soiled. Moreover the projection of the knob causes an unwanted encumbrance on the upper portion of the cartridge.

An ink ribbon cartridge is also known, in which the ink ribbon is unwound from one spool to another spool by passing through a pair of apertures and it is guided to the exterior of the cartridge by a lift ribbon guide mounted on two arms of the cartridge. A cam device then lifts not only the portion of ink ribbon external to the cartridge, but also the entire mass either of the ink ribbon of the cartridge, so that there is required a costly lifting device which requires a great force and causes moreover in some circumstances vibrations on the machine on which the ink cartridge is mounted.

SUMMARY OF THE INVENTION

The main object of the present invention is to provide a device which eliminates the disadvantages of the prior art devices.

Another object of the present invention is to obtain an ink or carbon ribbon cartridge in which a portion of the ink or carbon ribbon is away from a rear wall of the container for making the insertion of the ink or carbon ribbon in the lift ribbon guide.

A further object of the invention is to create a cartridge which can be used either for ink ribbon or for carbon ribbon and which is of relatively low cost, which does not require a costly feed device and which can be mounted securely and simply on the office machine.

According to the present invention, there is provided a cartridge for an ink or carbon ribbon of an office machine, comprising a container of parallelepipedal form and a pair of spools for winding the ink or carbon ribbon thereon. The ink or carbon ribbon passes from one spool out of a first aperture and back into the container through a second aperture in the container for winding on another spool. The apertures have means for guiding the portion of the ribbon external of the cartridge comprising associated therewith a pair of arm members, each associated with one aperture. The arm members project from a rear portion of the exterior of the container and support the external portion of the ink or carbon ribbon away from the rear portion of the container, when the container is removed from the machine, for making an easy insertion of the ink or carbon ribbon in a pair of lift ribbon guides when the container is mounted in the machine. Further, the container has at the top wall thereof a window over the periphery of an upper flange of one of the two spools. The window is adapted for manually rewinding the ink or carbon ribbon on the one of two spools when the container is mounted on the feed device of the machine.

DESCRIPTION OF THE DRAWING

A preferred embodiment of the invention is presented by way of example in the following description and shown in the accompanying drawing, in which.

DETAILED DESCRIPTION OF THE PREFERRED EMBODIMENTS

Figure 1:
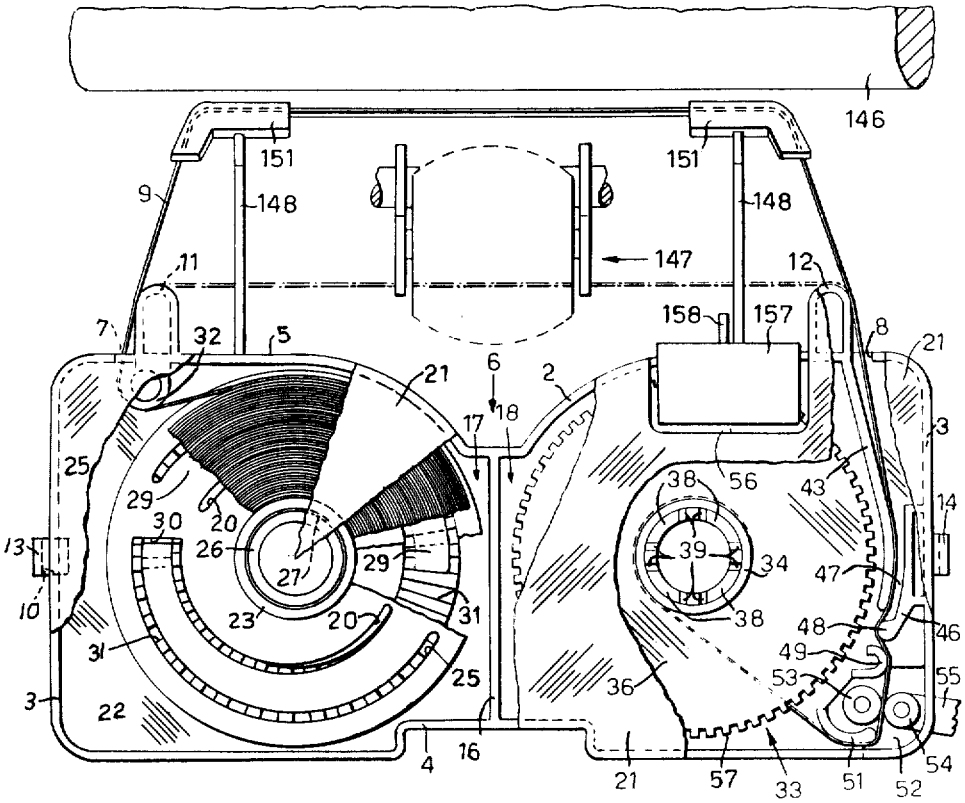
FIG. 1 is a partial plan view of a carbon ribbon cartridge of a first embodiment of the invention.

Referring to FIG. 1, there is shown a carbon ribbon cartridge 6 comprising a container 5 of plastic material which has a parallelepipedal configuration. The container 5 comprises a bottom 1, a rear wall 2, two side walls 3 and a front wall 4. The cartridge 6 has in the rear wall 2 of the container 5, two apertures 7 and 8 which are adapted to permit the passage of a carbon ribbon 9 therethrough.

Means for guiding the portion of the carbon ribbon 9 external of the container 5 comprises a pair of arm members 11 and 12 associated with each of the apertures 7, 8, respectively, which support a part of the carbon ribbon 9, when the cartridge 6 is not mounted on the machine as shown in FIG. 1 with the dotted line.

Figure 2:
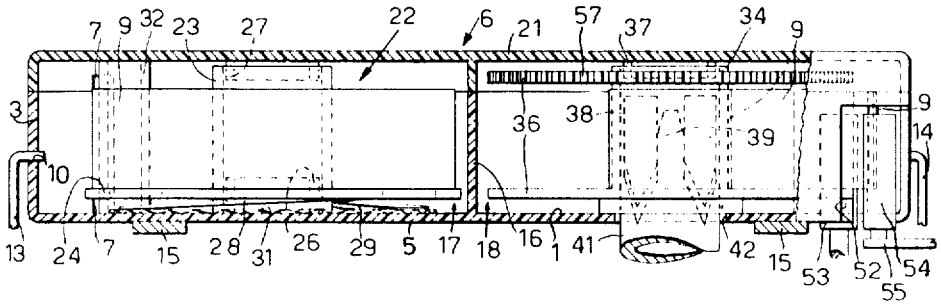
FIG. 2 is a front view, partly in section, of the cartridge of FIG. 1.

The container 5 is divided by a central rib 16 into two substantially equal chambers 17 and 18 and is closed at the top by a cover 21. The cartridge 6 is held removably fixed on a support 15 (FIG. 2) of the machine, for example by a pair of resilient tongues 13 and 14 which engage laterally in corresponding slots 10 in the side walls 3 of the container 5 in manner known per se.

In the chamber 17 (FIG. 1) there is housed a feed spool 22 on which is wound the carbon ribbon 9, the spool 22 being constituted by a hollow tube 23 and a bottom flange 24. The lower end of the tube 23 bears on the bottom 1 of the container 5 and the spool 22 (FIG. 2) is guided at the bottom and top by means of the tube 23 by two coaxial sleeves 26 and 27 integral with the bottom 1 of the container 5 and the cover 21 respectively.

The flange 24 (FIG. 1) is provided with two pairs of concentric slots 20 and 25 connected by two radial slots 30 of which only one is shown in FIG. 1. The slots 20, 25 and 30 define two diametrically opposed arcuate tongues 28 and 29. These tongues 28, 29 project at the bottom from the plane of the flange 24 to bear resiliently on a notched or serrated ring 31 projecting from the bottom 1 of the container 5 and having a high coefficient of friction, which prevents the spool 22 turning freely about the sleeves 26 and 27, and thus prevents slackening of the turns of the wound carbon ribbon 9. In the chamber 17 there is moreover housed a cylindrical element 32 immediately adjacent the aperture 7 and the arm member 11, for guiding the carbon ribbon 9 towards the aperture 7.

In the chamber 18 there is housed a take-up spool 33 constituted by a tube 34 (FIG. 2) and two flanges 36. The lower end of the tube 34 bears on the bottom 1 of the container 5 and the spool 33 (FIG. 1) is guided at the top by a sleeve 37 (FIG. 2) integral with the cover 21. The tube 34 has inside it four suitably shaped teeth 38 adapted to engage with notches 39 of inverted pyramidal form in a shaft 41 of the machine. This shaft 41 is accommodated in a hole 42 in the bottom 1 of the container 5 and forms part of a frictional rotation device for the spool (FIG. 1), this device being known per se and not shown in the drawing.

In the chamber 18 there are arranged guide and friction means for the carbon ribbon 9 which comprise a pair of tongues 43 and 46 leading towards the aperture 8. The tongue 43 is connected to the rear wall 2 of the container 5 immediately adjacent the aperture 8 and has a terminal portion in the form of a circular sector with a radius slightly larger than that of the flanges 36. The tongue 46 is disposed opposite the circular portion of the tongue 43 so as to define a channel 47 through which the carbon ribbon 9 passes. The tongue 46 terminates in a cylindrical element 48 on which the carbon ribbon 9 bears. Another curved tongue 49 is disposed at the side of the cylindrical element 48 in such manner that the carbon ribbon 9 guided by the channel 47 first follows a rectilinear path and then, guided by the element 48 and by the tongue 49, follows a V-shaped path towards the front corner of the cartridge 6 adjacent the spool 33. Another curved tongue 51 also in the form of a circular sector finally guides the carbon ribbon 9 towards the spool 33. The ribbon-guiding tongues 43, 46, 49 and 51 are fixed to the bottom 1 of the container 5 and have a height substantially equal to the height of the carbon ribbon 9.

At the corner of the container 5 adjacent the spool 33 which is opposite the aperture 8, the container 5 is provided at the bottom 1 with an opening 52 disposed in correspondence with the tongues 49 and 51. The opening 52 is adapted to receive a driving roller 53 and a pressure roller 54 mounted on a member 55 of a feed device of the machine, which device is known per se and not shown in the drawing.

The driving roller 53 is freely engaged at the bottom in a part of the opening 52 which is defined in the part facing the take up spool 33 between the tongues 49 and 51. The pressure roller 54 is urged resiliently against the driving roller 53 and is accommodated at the location of a break in the front wall 4 and side wall 3 of the container 5 converging towards the corner in which the opening 52 is formed. In this way, the pressure roller 54 presses the carbon ribbon 9 against the driving roller 53 with a lateral movement. The carbon ribbon 9 is caused to advance or is fed in the operative position of the cartridge 6 by the rotation of the driving roller 53, while the take-up spool 33 is caused to rotate by the shaft 41 (FIG. 2) independent of the driving roller 53. During the advance of the carbon ribbon 9, the friction between the tongue 28 of the feed spool 22 and the ring 31 and the friction encountered by the carbon ribbon 9 from the guide and friction means 43, 46, 48, 49 and 51 (FIG. 1) already described ensures a movement of the carbon ribbon 9 free from slackening or over-tension.

When the cartridge 6 is removed from the machine, the guide and friction means 43, 46, 48, 49 and 51 already described prevent the carbon ribbon 9 from occupying that part of the opening 52 which is intended for the driving roller 53, allowing convenient and secure mounting of the cartridge 6 on the machine. The tongues 49 and 51, moreover, prevent contact of any possible slackened turns of the take up spool 33 with the roller 53 or 54.

Finally, the cartridge 6 has at the rear in the cover 21 a window 56 formed over the take-up spool 33. The window 56 permits manual rotation of a milled edge 57 of the top flange 36 for rotating the take up spool 33 clockwise and recovering the carbon ribbon 9, therefore placing it under tension after the cartridge 6 has been mounted on the support 15 (FIG. 2) of the machine.

The aforesaid window 56 (FIG. 1) and arm members 11 and 12 can be used also in an ink ribbon cartridge 106 (FIG. 3) in a second embodiment. The ink ribbon cartridge 106 comprises a container 107 of plastic material, which has a parallelepipedal configuration. The container 107 (FIG. 3) comprises a bottom 108, a rear portion or wall 109, two lateral portions or side walls 111 and a front portion or wall 112. Two apertures 113 and 114 of the rear wall 109 are adapted to permit the passage of an ink ribbon 116 therethrough between two rotatable spools 117 and 118. Means for guiding the portion of the ink ribbon 116 external of the container 107 comprising, mounted in the container 107, a pair of arm members 121 and 122 substantially similar to the arm members 11 and 12 (FIG. 1) and associated with the apertures 113 (FIG. 3) and 114 respectively, projecting from the rear wall 109 towards the exterior of the container 107. The arm members 121 and 122 support a part of the ink ribbon 116 away from the rear wall 109 when the container 107 is not mounted on the machine.

Figure 4:
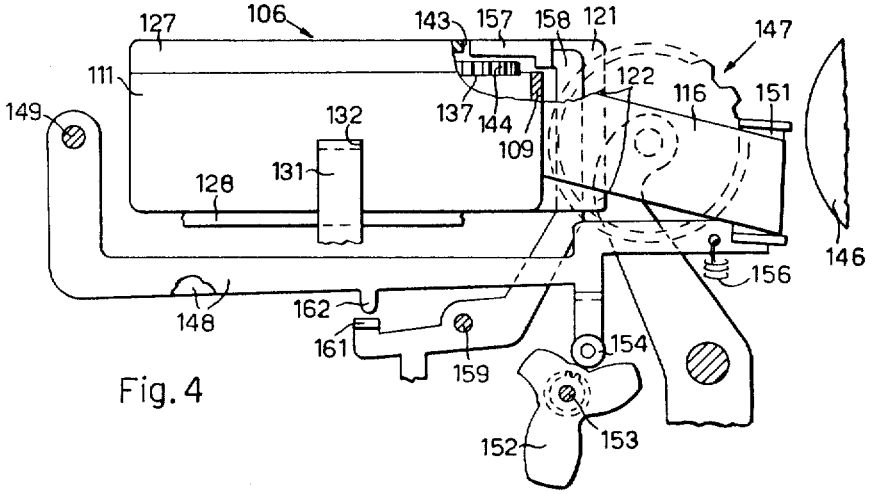
FIG. 4 is a partial right elevation view of the cartridge of FIG. 3.

The container 107 is divided by a central rib 123 into two substantially equal chambers 124 and 126 and is closed at the top portion by a cover 127. The ink ribbon cartridge 106 is held removably fixed on a support 128 (FIG. 4) of the machine by a pair of resilient tongues 131 (FIG. 3), which laterally engage in corresponding slots 132 in the side walls 111 of the container 107 in a manner known per se.

Figure 3:
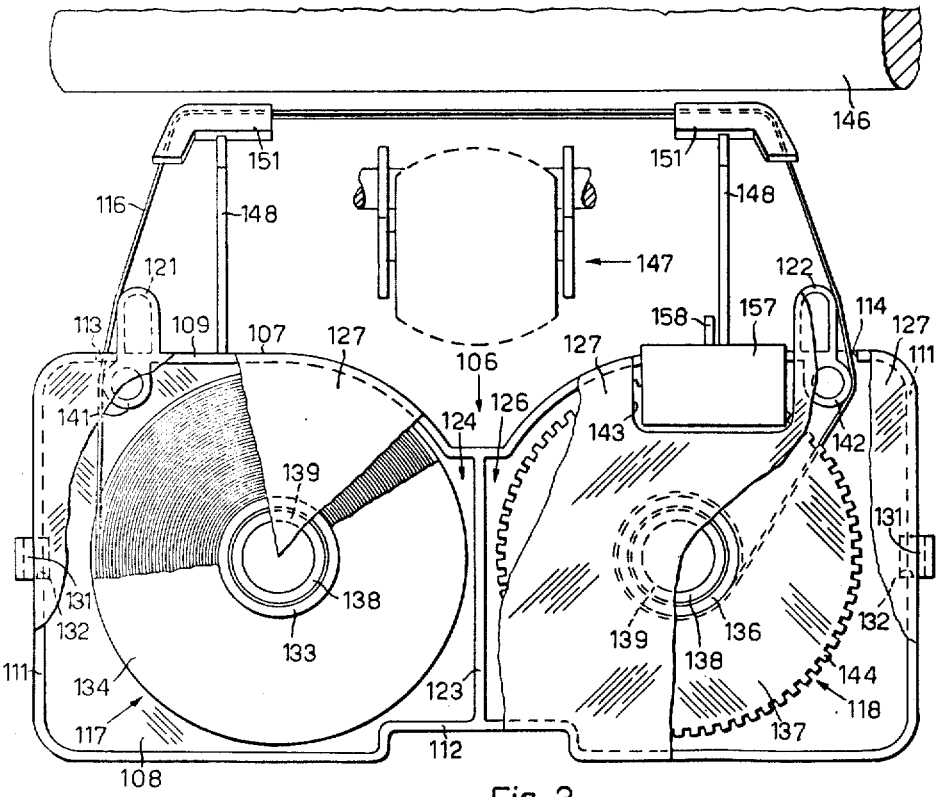
FIG. 3 is a partial plan view of an ink ribbon cartridge of a second embodiment of the invention.

In the chambers 124 and 126, there are housed the spools 117 and 118 respectively on which is wound the ink ribbon 116. The spool 117 is constituted by a hollow tube 133 and a bottom flange 134 and the spool 118 is constituted by a hollow tube 136 and two flanges 137 of which only one is shown in FIG. 3. The lower end of the tube 133 and of the tube 136 bears on the bottom 108 of the container 107 and the spools 117 and 118 are guided at the bottom and top by means of the tubes 133, 136 respectively by two coaxial sleeves 138 and 139 integral with the bottom 108 and the cover 127 respectively. Moreover in each chamber 124, 126 there is housed a cylindrical element 141, 142 immediately adjacent the aperture 113, 114 for guiding the ink ribbon 116 towards the aperture 113, 114.

The ink ribbon cartridge 106 has at the rear of the cover 127 a window 143 formed over the spool 118. The window 143 permits manual rotation of a milled edge 144 of the top flange 137 for rotating the spool 118 recovering the ink ribbon 116, therefore placing it under tension after the ink ribbon cartridge 106 has been mounted on the machine. The ink ribbon 116 is caused to advance or is fed in the operative position of the ink ribbon cartridge 106 by a ribbon reversed feed mechanism known per se and not shown in FIGS. 1–4.

The machines on which the carbon ribbon cartridge 6 (FIG. 1) and the ink ribbon cartridge 106 (FIG. 3) can be mounted comprise a platen 146 (FIGS. 1 and 3), a type head 147 carrying a plurality of characters and a ribbon lift guide 148. The ribbon lift guide 148 comprises a pair of levers, which can rotate about a spindle 149 (FIG. 4) and two supports 151 (FIGS. 1 and 3) for guiding the carbon ribbon 9 or the ink ribbon 116 in front of a typing point of the platen 146. A cam 152 (FIG. 4) is mounted on a motor shaft 153 and is adapted to co-operate with a small roller 154 integral with one of the pair of levers 148 by a spring 156, which biases the small roller 154 against the cam 152. The cam 152 has three lobes for lifting the ribbon lift guide 148 and make use all the ink ribbon 116 in its height. A lid 157, integral with a lever 158 which can rotate about a spindle 159, shuts the window 143 when the carbon ribbon cartridge 6 (FIG. 1) or the ink ribbon cartridge 106 (FIG. 3) is mounted on the machine. Moreover the lever 158 comprises a tongue 161 (FIG. 4) to co-operate with a shoulder 162 of the lever 148 for lifting the levers 148 with the carbon ribbon 9 (FIGS. 1 and 3) or ink ribbon 116 when the cartridge 6 or 106 is mounted on the machine.

Since the assembly on the machine of the ink ribbon cartridge 106 is similar to the assembly of the carbon ribbon cartridge 6, for simplicity of the description, we refer only to the assembly of the ink ribbon cartridge 106.

To replace a used cartridge by a new one, one acts in the following manner. With one hand one rotates, in a clockwise direction, the lid 157 (FIG. 4) and the lever 158, which, by the action of the tongue 161 on the shoulder 162, lifts the levers 148 and the supports 151 until the supports 151 are lifted higher than the typing point facilitating the assembly of the ink ribbon 116 on the supports 151 without handling the ink ribbon 116.

The used ink ribbon cartridge 106 is lifted off with one hand and it is replaced by a new one. The portion of ink ribbon 116 extends to the exterior of the cartridge 106 is supported by the corresponding arm member 121 (FIG. 3) and 122 away from the rear portion 109, as shown in FIG. 1 with dotted line the carbon ribbon 9. The distance between the rear wall 109 (FIG. 3) and the ink ribbon 116 permits the passage first of one of the supports 151 and subsequently the other. Now, with one hand the ink ribbon cartridge 106 is fitted on the supports 128 (FIG. 4) of the machine so as to bring the slots 132 into engagement with the resilient tongues 131. Then through the window 143 one rotates the milled edge 144 (FIG. 3) of the top flange 137 for rotating the spool 118 in a clockwise direction and recovering the ink ribbon 116, placing it under tension. Thereafter with one hand one rotates the lid 157 and the lever 158 in the counterclockwise direction until the lid 157 covers the window 143 and the spring 156 (FIG. 4) re-engages the small roller 154 with the cam 152.

We claim:

1. A ribbon cartridge removably mountable on a feed device of a typewriter, calculating machine, accounting machine or other office machines having a platen, a type head opposite said platen and carrying a plurality of characters, a support opposite said head for mounting said cartridge and a ribbon lift guide including a pair of supports embracing the type head and located between the platen and type head for guiding the ribbon in front of a typing point of said platen, said supports being spaced a predetermined distance therebetween, and a manually operable member for lifting the ribbon guide, said ribbon cartridge comprising:

a single container having substantially parallelepipedal configuration having a top portion, a rear portion and two lateral portions;

a pair of rotatable spools having a ribbon wound thereon;

means for rotatably mounting said pair of spools in said container at a reciprocally fixed distance; and means for guiding the portion of said ribbon external to said container to space said portion of said ribbon from the rear portion of said container and enabling said external portion of said ribbon to be further spaced from said rear portion when engaged with the ribbon lift guide in the lifted position thereof, the guide means comprising means defining a pair of apertures in said rear portion adjacent to said lateral portions, a part of said ribbon extending through one of said pair of apertures to the external of said container and returning into the interior of said container through other of said pair of apertures and a pair of arm members fixed to said container adjacent to said pair of apertures and projecting from said rear portion towards the exterior of said container, said pair of arm members being spaced therebetween more than the predetermined distance of said pair of supports and supporting said external portion of said ribbon away from said rear portion of said container when said container is to be mounted in said feed device for facilitating the insertion or the removal of said ribbon with respect to said pair of supports of said lift ribbon guide by only moving the single container upon mounting or removing said cartridge with respect to said support.

2. A ribbon cartridge according to claim 1, wherein said operable member comprises a lid movable between a rest position, in which it holds said pair of supports higher than the typing point, and an operative position in which it holds the supports lower than said typing point and wherein one of said pair of spools include an upper flange opposite said top portion of said container and adjacent to one of said pair of arm members and wherein said top portion of said container has a window over the periphery of said upper flange for enabling manual rewinding of said ribbon on said one of said pair of spools when the container is mounted on said feed device in the rest position of said lid, the window of said top portion being configured to accommodate said lid in the operative position thereof, thereby closing said window.

3. A ribbon cartridge according to claim 1, wherein said ribbon is of the carbon type, said one of said pair of spools is a take-up spool and the other of said pair of spools being a feed spool, wherein said container further comprises a bottom portion including a ring having a high friction coefficient disposed adjacent to one of said pair of arm members, wherein the feed spool includes a bottom flange adjacent to said other one of said pair of arm members, said bottom flange having two concentric slots connected by two radial slots, said concentric slots and said two radial slots defining two diametrically opposed arcuate tongues projecting from the plane of said flange to rub resiliently on said ring for preventing undesired rotation of said spool during the operation of said feed device.

* * * * *